US005844353A

United States Patent [19]

Nam

[11] Patent Number: 5,844,353

[45] Date of Patent: Dec. 1, 1998

[54] COUPLING STRUCTURE OF CONVERGENCE CORRECTION MECHANISM FOR DEFLECTION YOKE

[75] Inventor: Sang Wook Nam, Seoul, Rep. of Korea

[73] Assignee: Samsung Electro-Mechanics Co.Ltd, Suwon, Rep. of Korea

[21] Appl. No.: 785,171

[22] Filed: Jan. 13, 1997

[30] Foreign Application Priority Data

May 29, 1996 [KR] Rep. of Korea ..... 1996-18435

[51] Int. Cl.[6] ..... H01J 29/70; H01F 7/00

[52] U.S. Cl. ..... 313/440; 335/210

[58] Field of Search ..... 313/412, 413, 313/414, 440, 456; 335/209, 210, 296, 297

[56] References Cited

U.S. PATENT DOCUMENTS 4,908,591 3/1990 Anthony ..... 335/210

5,191,253 3/1993 Kang ..... 313/440

5,204,648 4/1993 Jei ..... 335/210

5,289,149 2/1994 Nishita et al. ..... 335/210

5,592,045 1/1997 Dossot et al. ..... 313/440

*Primary Examiner*—William L. Oen

*Attorney, Agent, or Firm*—Ladas & Parry

[57] ABSTRACT

A coupling structure of a convergence correction mechanism including a magnet set has a connecting member with an extension part for fitting axially onto one of a cathode ray tube and a neck part of a coil separator on the cathode ray tube and with an insertion part extending axially to a tip end from one axial end of the extension part for receiving the magnet set.

4 Claims, 4 Drawing Sheets

COUPLING STRUCTURE OF CONVERGENCE CORRECTION MECHANISM FOR DEFLECTION YOKE

BACKGROUND OF THE INVENTION

1. Field of the Invention

The present invention relates to a magnet set for convergence correction on a cathode ray tube (CRT) and, in particular to a magnet set that can be provided in either of two ways, i.e. as hereinafter called an integrated type in which the magnet set is assembled to the CRT when ready fitted on a coil separator of a deflection yoke therefor, and as hereinafter called a separate type in which the magnet set is assembled to the CRT separately from the coil separator of a deflection yoke.

2. Description of the Prior Art

In general, when a deflection yoke is assembled to a CRT, a magnet set is used as a convergence correction mechanism (hereinafter, the magnet set may be referred to as "convergence correction magnet set"). It is fitted onto the neck part of the deflection yoke for alignment of the dynamic convergence. The magnet set can be assembled to the CRT either fitted on or separately from the neck part of the separator coil in the deflection yoke, depending on the characteristic differences of the CRT (e.g. positional differences of the electron guns in the CRT). Specifically, with the so-called "separate type", the magnet set is directly mounted on at an electron gun and movable to change the position of the magnet set to a certain extent in designing a CRT, and with the so-called "integrated type", the electron gun is movable to align the dynamic convergence even though the deflection yoke and the CRT have been optimally assembled and the magnet set and the deflection yoke have been integratedly mounted.

Therefore, convergence correction magnet sets must be produced either in the integrated type or in the separate type in accordance with a customer's order, and thus, coil separators also must be manufactured in any of these two types to meet the order. As a result, the coil separators (c) of the integrated type and the coil separators (d) of the integrated type are different in shapes of their neck parts (a), as shown in FIGS. 7 and 8. In this regard, the most difficult problem is manufacturing as some of the magnet sets must be formed directly on the neck parts and some of magnet sets must be formed separately from the neck parts of the coil separators. Furthermore, the second, fourth and sixth poles of the magnet sets must be separately manufactured and then inserted into the magnet sets to complete the magnet sets even though they are produced in the integrated type.

SUMMARY OF THE INVENTION

Accordingly, the present invention is conceived to solve the problems as explained in the above. A principal object of the present invention is to provide a coupling structure of convergence correction mechanism which can be used either in the separate type or in the integrated type by separately preparing coil separators and magnet sets to be mounted on the neck parts of the coil separators for aligning convergence, so that, when used in the separate type, the magnet set and the coil separator can be separately mounted on a CRT and, when used in the integrated type, the magnet set can be assembled on the neck part of the coil separator and then can be mounted on a CRT under the assembled state.

Another object of the present invention is to provide the dual types of coupling structure which can be compatibly produced at once.

The characteristic construction of the present invention includes a magnet set which comprises a connecting member with an extension part to be fitted onto the neck part of a coil separator and with an insertion part extended from the one end of the extension part, and a plurality of convergence correction magnets fitted onto the insertion part of the connecting member, whereby the magnet set can be assembled to a CRT at a state either fitted on or separated from the neck part of the coil separator.

BRIEF DESCRIPTION OF THE DRAWINGS

The above objects, other features, and advantages of the present invention will become more apparent by describing the preferred embodiment thereof with reference to the accompanying drawings, in which.

DETAILED DESCRIPTION OF THE PREFERRED EMBODIMENTS

Figure 1:
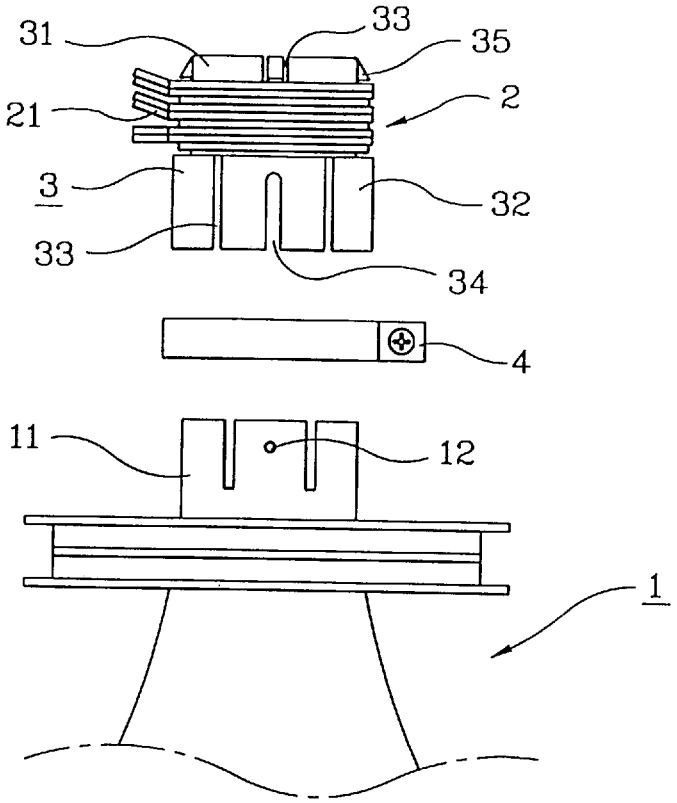
FIG. 1 is a front view showing a coupling structure according to the present invention in partially disassembled state.
Figure 2:
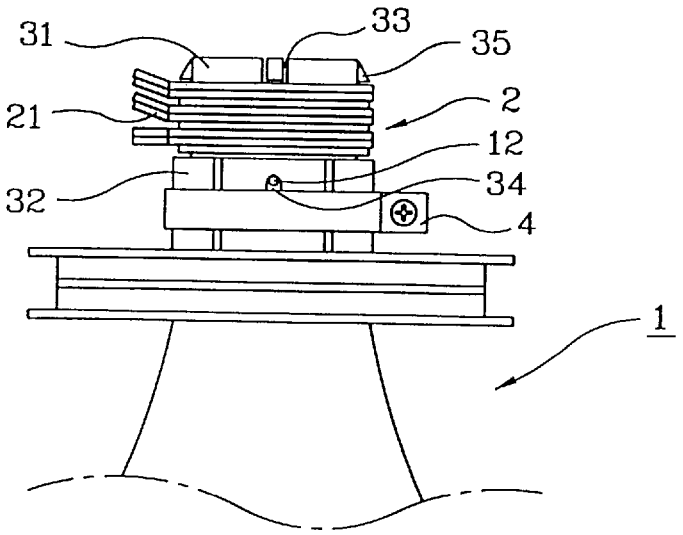
FIG. 2 is a front view showing the coupling structure shown in FIG. 1 in assembled state.

FIG. 1 is a front view showing a convergence correction mechanism of the present invention used in the separate type and FIG. 2 illustrates the convergence correction mechanism used in the integrated type, in each of which drawings a magnet set 2 and a coil separator 1 are shown.

Figure 3:
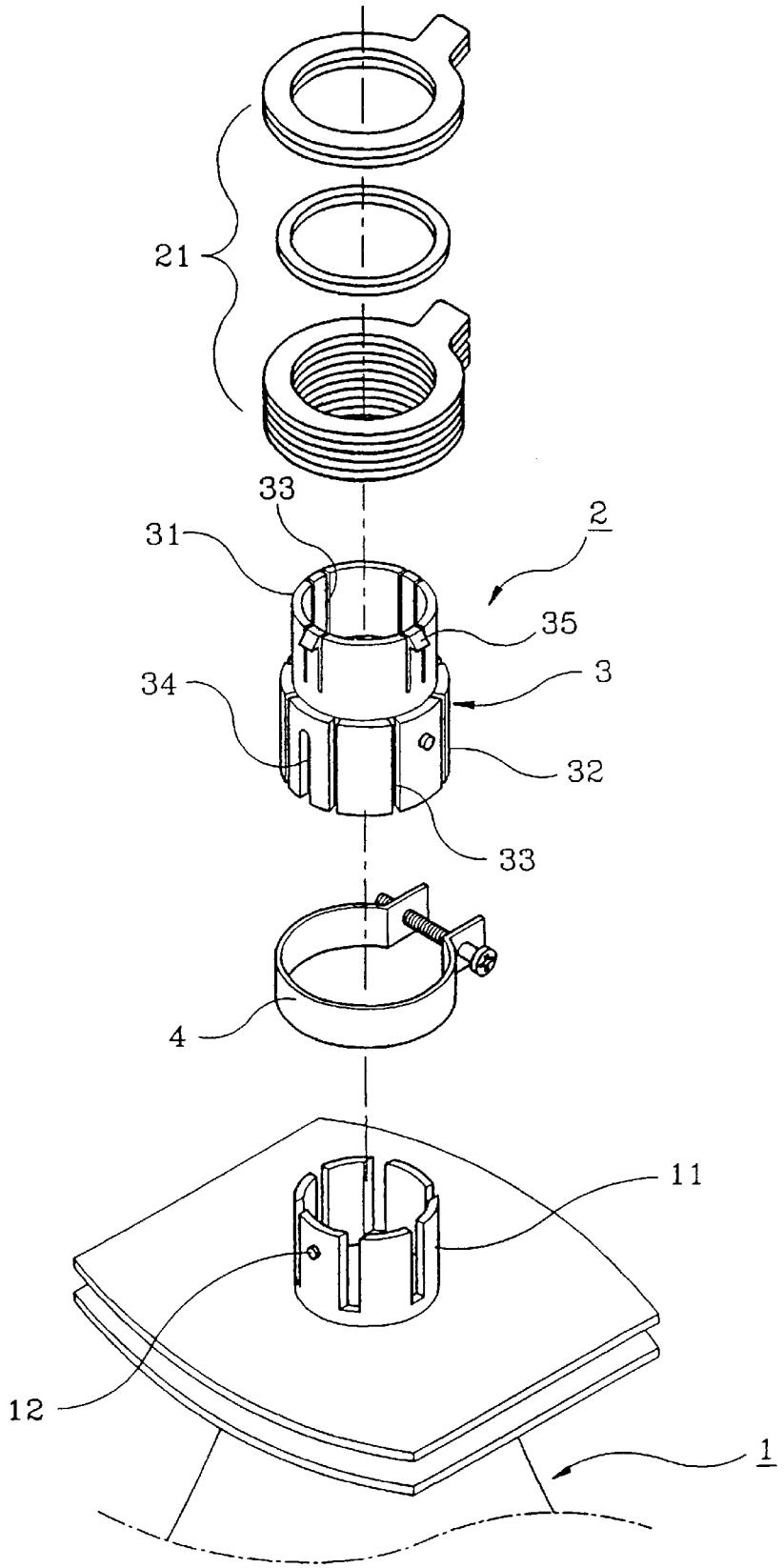
FIG. 3 is a exploded perspective view showing a magnet set and the neck part of a coil separator according to the present invention.

Referring to FIG. 3, the convergence correction magnet set 2 includes a cylindrical connecting member 3 with an insertion part 31 and an extension part 32. A number of ring-shaped magnets 21 are fitted on the insertion part 31 and the neck part 11 of a coil separator 1 is inserted into the extension part 32.

Figure 4:
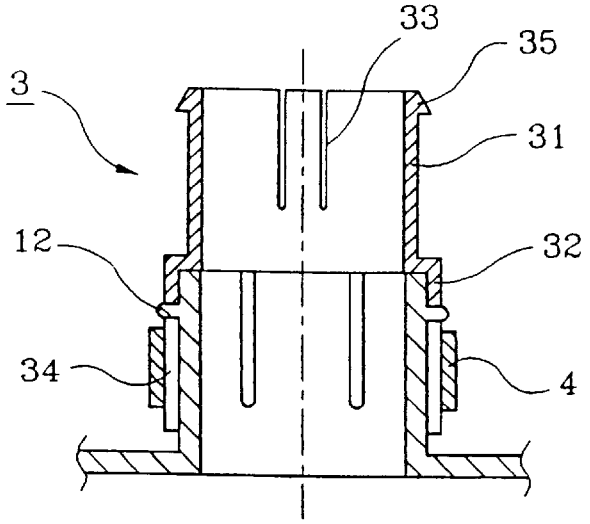
FIG. 4 is a vertical section view showing the extension part in the locked state.
Figure 5:
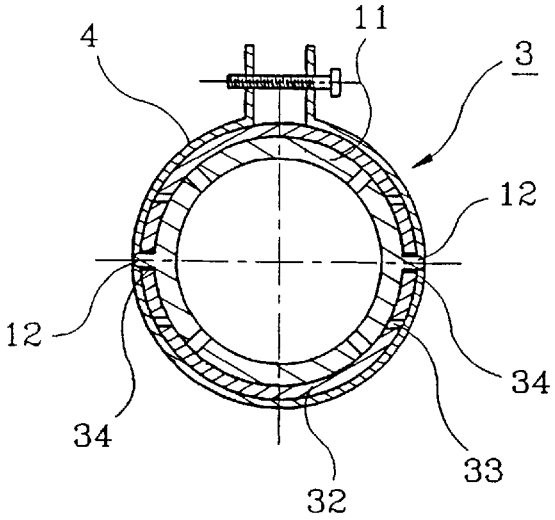
FIG. 5 is a horizontal section view showing the extension part in the locked state.

The extension part 32 is provided with longitudinal connecting slots 34, into each of which slots a projection 12 formed on the external circumferential surface of the neck part 11 is inserted, and a clamp 4 is mounted to prevent the extension part from being shaken or rotated on the neck part, as shown in FIG. 4.

Figure 6:
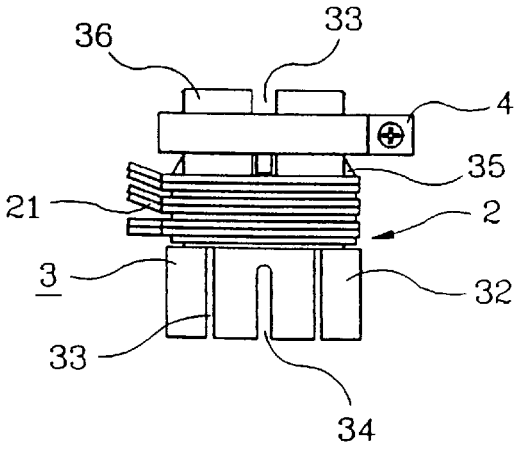
FIG. 6 is a front view showing another embodiment of the present invention.
Figure 7:
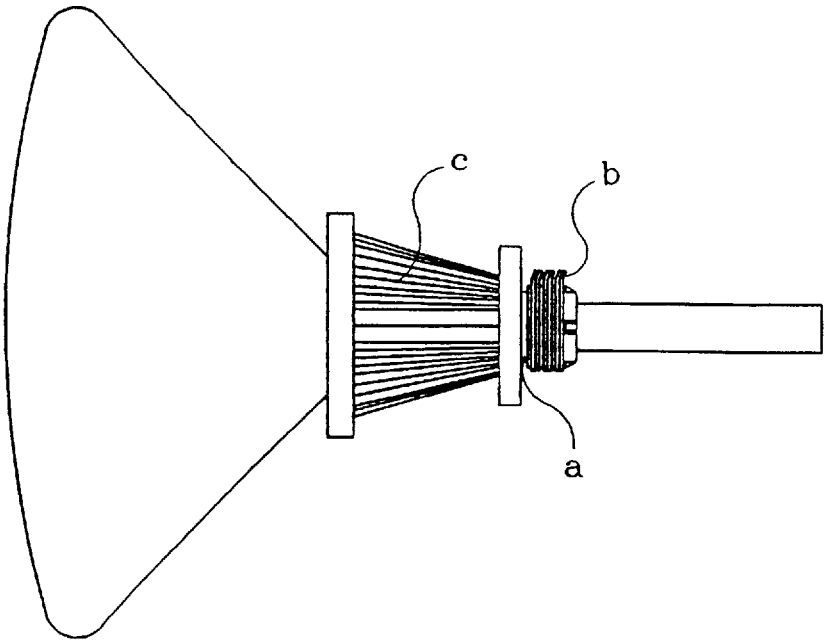
FIG. 7 shows a deflection yoke including a convergence correction mechanism of the integrated type of prior art.
Figure 8:
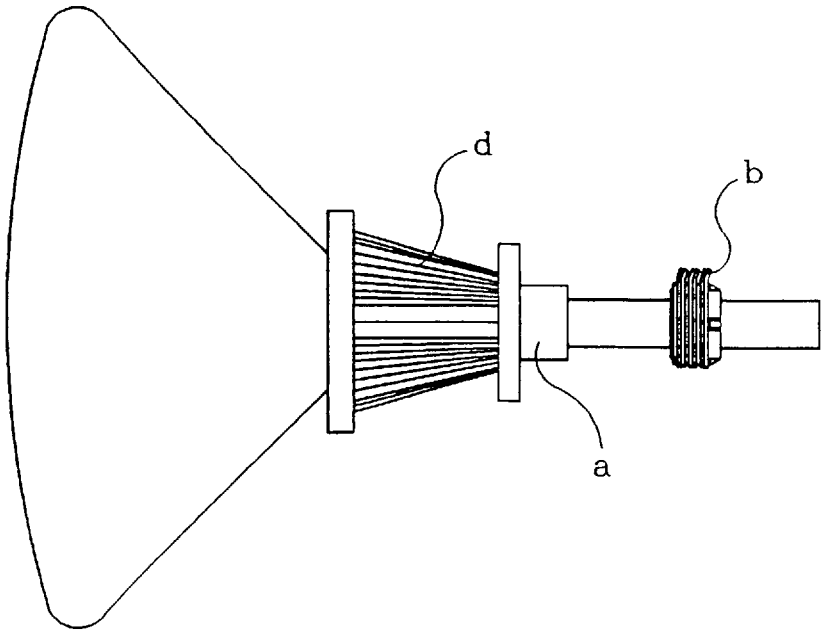
FIG. 8 shows a deflection yoke including a convergence correction mechanism of the separate type of prior art.

In addition, the insertion part 31 is provided with several slits 33 and locking protrusions 35 located on each pair of those slits 33 to facilate the mounting of ring shaped magnets 21, and the extension part 32 is also provided with several slots 33 to facilate the insertion of the neck part thereto. As shown in FIG. 6, a clamping part 36 may be formed at the tip end of the insertion part so that another clamp can be used to assemble the magnet set when only the magnet set is mounted on a CRT.

The assembled and disassembled states of the present invention constructed as explained in the above will be explained.

If it is needed to manufacture a deflection yoke having a magnet set integrated thereto, as shown in FIG. 2, magnets 21 are fitted onto the insertion part 31 of the connecting member 3, and then the extension part 32 of the connecting member 3 is fitted onto the neck part 11 of the coil separator. After this, the clamp 4 is mounted on the extension part 32 and clamped, and thus the neck part 11 and the extension part 32 are integratedly assembled. In this regard, the projections 12 formed on the neck part 11 should be precisely positioned and clamped in the slots 34 of the extension part 32, respectively, so that there will be no relative rotation and play therebetween. The integrated type deflection yoke prepared in this way will be mounted on a CRT together with the magnet set fitted thereon.

If it is needed to manufacture a deflection yoke having the convergence correction magnet set 2 separated therefrom, as shown in FIG. 1, the magnet set 2 is separately prepared by assembling magnets 21 to the insertion part 31 of the connecting member 3, leaving the neck part 11 of the coil separator 1 of the deflection yoke as it is. Therefore, the deflection yoke and the convergence correction magnet set 2 of the separate type are separately assembled to a CRT, and thus, the position of the magnet set 2 relative to the deflection yoke can be changed to some extent.

As explained in the above in detail, the present invention has advantages in that, since a convergence correction magnet set 2 is provided with a connecting member 3 and the connecting member 3 is removably fitted onto the neck part 11 of a coil separator 1, both of the integrated type yoke with the convergence correction magnet set fitted thereon and the separate type yoke with the convergence correction magnet set separated therefrom can be compatibly produced at once without any additional and separate production facilities or processes, and therefore, the productivity can be highly increased and the production costs can be extremely reduced.

What is claimed is:

1. In a coupling structure of a convergence correction mechanism including a magnet set, the improvement comprising:

a connecting member with an extension part for fitting axially onto one of a cathode ray tube and a neck part of a coil separator on the cathode ray tube and with an insertion part extending axially to a tip end from one axial end of the extension part for receiving the magnet set.

2. The coupling structure in accordance with claim 1, wherein the tip end of the insertion part has a clamping part for receiving a clamp to the cathode ray tube.

3. The coupling structure in accordance with claim 1, wherein the connecting member has axial connecting slots on the extension part, each for receiving a projection on the neck part of the coil separator, whereby to fix the magnet set without play, when the connecting member is fitted onto the neck part of the coil separator.

4. The coupling structure in accordance with claim 2, wherein the connecting member has axial connecting slots on the extension part, each for receiving a projection on the neck part of the coil separator, whereby to fix the magnet set without play, when the connecting member is fitted onto the neck part of the coil separator.

* * * * *